United States Patent [19]

Ledebrink et al.

[11] Patent Number: 4,676,175

[45] Date of Patent: Jun. 30, 1987

[54] INCINERATOR FURNACE

[75] Inventors: Friedrich-Wilhelm Ledebrink, Neuberg; Karl-Rupprecht Link, Rodenbach, both of Fed. Rep. of Germany

[73] Assignee: Alkem GmbH, Hanau, Fed. Rep. of Germany

[21] Appl. No.: 788,857

[22] Filed: Oct. 18, 1985

[30] Foreign Application Priority Data

Oct. 22, 1984 [DE] Fed. Rep. of Germany ..... 3438681

[51] Int. Cl.[4] ..... F23G 5/12

[52] U.S. Cl. ..... 110/235; 110/237; 110/251

[58] Field of Search ..... 110/235, 237, 244, 243, 110/250, 251

[56] References Cited

U.S. PATENT DOCUMENTS

| | | | |
|---|---|---|---|
| 1,086,366 | 2/1914 | Hirt | 110/235 |
| 1,692,448 | 11/1928 | Jones | 110/235 |
| 4,048,927 | 9/1977 | Mallek et al. | 110/237 |
| 4,116,136 | 9/1978 | Mallek et al. | 110/251 |
| 4,184,437 | 1/1980 | Mallek et al. | 110/251 |
| 4,194,455 | 3/1980 | Mallek et al. | 110/251 |
| 4,261,269 | 4/1981 | Mallek et al. | 110/251 |
| 4,277,362 | 7/1981 | Mallek et al. | 110/237 |
| 4,334,953 | 6/1982 | Sridhar | 55/523 |
| 4,414,906 | 11/1983 | Hartouni | 110/251 |
| 4,499,832 | 2/1985 | McNeil | 110/237 |

FOREIGN PATENT DOCUMENTS

| | | | |
|---|---|---|---|
| 1224861 | 9/1966 | Fed. Rep. of Germany . | |
| 2734973 | 2/1979 | Fed. Rep. of Germany | 110/251 |
| 2284823 | 4/1976 | France . | |
| 2357293 | 2/1978 | France . | |
| 2399613 | 3/1979 | France . | |

*Primary Examiner*—Henry C. Yuen

*Attorney, Agent, or Firm*—Herbert L. Lerner; Laurence A. Greenberg

[57] ABSTRACT

Incinerator furnace for incinerating organic substances, especially compounds which contain radioactive actinides in chemically bound form or are contaminated with chemical compounds, having an incinerating chamber which has a feed opening for oxygen-containing gas, a discharge opening for exhaust gas, and a filter body of the exhaust gas stream. The filter body is cup-shaped, and is arranged with its opening at the feed opening for oxygen-containing gas. The filter body on the side facing the feed opening for oxygen-containing gas forms a receiving space for the organic substances.

4 Claims, 1 Drawing Figure

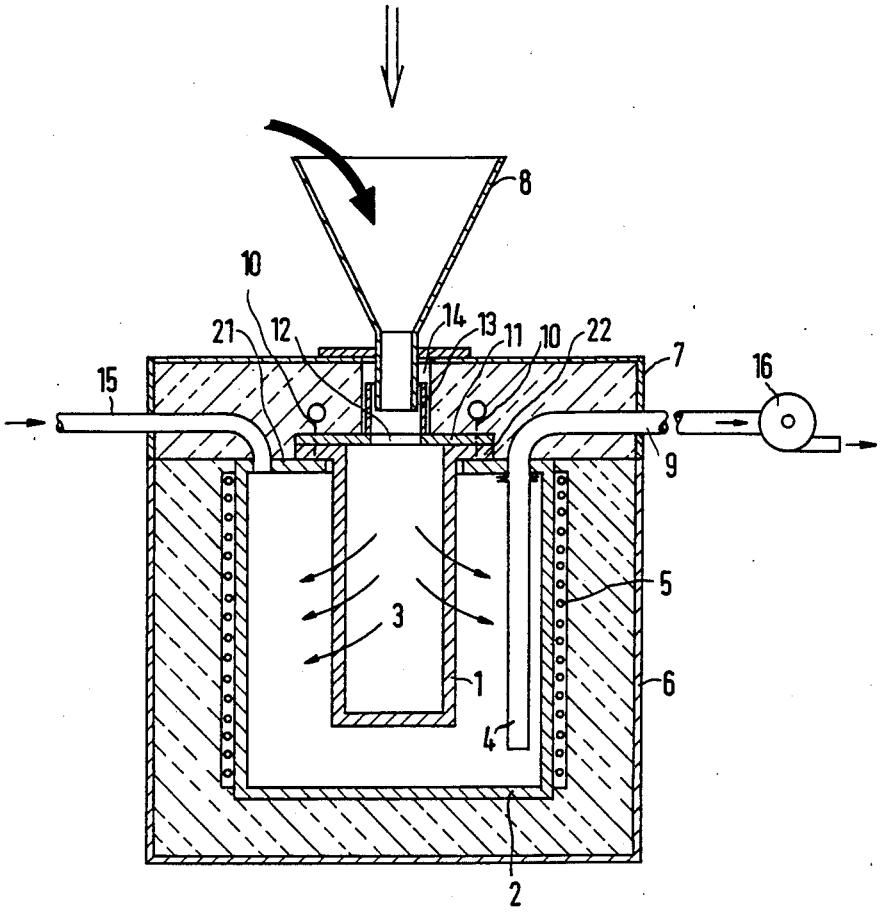
8
10
21
12
14
13
11
10
22
7
16
15
9
5
3
1
6
4
2

INCINERATOR FURNACE

BACKGROUND OF THE INVENTION

1. Field of the Invention

The invention relates to an incinerator furnace for incinerating organic substances, especially compounds which contain radioactive actinides in chemically bound form, or substances which are contaminated with chemical compounds of these actinides. The incinerator chamber of the furnace has a feed opening for introducing oxygen-containing gas, an exit opening for discharging exhaust gas, and a filter body through which the stream of exhaust gas passes.

1. Description of the Prior Art

The filter body of such an incinerator furnace is customarily built into the exhaust pipe for the flue gas. This exhaust pipe can lead into a separate post-combustion chamber of the incinerator furnace. An exhaust gas pipe from the post-combustion chamber contains a further filter body for purifying the exhaust gas. The second exhaust gas pipe opens to the environment. The first exhaust pipe with the filter body, however, can also directly lead into the open air.

If an organic substance which contains harmful and dangerous substances, is incinerated in such an incinerator furnace, dust and ash are deposited everywhere in this incinerator furnace up to the filter body in the exhaust pipe. Such deposited dust and ash contain these harmful and dangerous substances and to remove them the incinerator furnace can be cleaned of them only at great cost.

SUMMARY OF THE INVENTION

It is an object of the invention to prevent harmful and dangerous substances stemming from an organic substance incinerated in a furnace, from spreading throughout the entire incinerator furnace and to localize accumulations of such dangerous and harmful substances only at definite points, more specifically in a restricted zone, in the incinerator furnace.

With the foregoing and other objects in view, there is provided in accordance with the invention an incinerator furnace for incinerating organic substances, especially compounds which contain radioactive actinides in chemically bound form, or substances which are contaminated with chemical compounds of the radioactive actinides comprising, an incinerating chamber, a feed opening in the chamber for the introduction of oxygen-containing gas, a discharge opening in the chamber for the discharge of exhaust gas, the combination therewith of a gas-permeable, cup-shaped filter body arranged in the chamber with the opening of the cup-shaped filter body at the feed opening for the introduction of oxygen-containing gas into a receiving space in the filter body for the organic substances to be incinerated, said filter body upon oxidation of the organic substances therein to gaseous constituents and higher boiling substantially non-volatile constituents effects separation of the gaseous constituents by permeation through the walls of the filter body while collecting and retaining the non-volatile constituents in the receiving space of the filter body.

Other features which are considered as characteristic for the invention are set forth in the appended claims.

Although the invention is illustrated and described as embodied in an incinerator furnace, it is nevertheless not intended to be limited to the details shown, since various modifications may be made therein without departing from the spirit of the invention and within the scope and range of equivalents of the claims.

BRIEF DESCRIPTION OF THE DRAWING

The invention, however, together with additional objects and advantages thereof will be best understood from the following description when read in connection with the accompanying drawing, in which is diagrammatically illustrated an incinerator furnace having a hollow cylindrical incinerating chamber, as charging hopper for introducing organic substances to be incinerated as well as combustion air into a feed opening in the chamber, a cup-shaped, gas-permeable filter body having a receiving space for the organic substances and with the filter body opening over the feed opening, a discharge opening in the chamber for the discharge of exhaust gas, and another opening in the chamber for the introduction of additional oxygen-containing gas. Combustion of the organic substances occurs in the filter body with the formation of gaseous constituents and substantially non-volatile substances which contain deleterious materials. The gaseous constituents separate by permeation. The non-volatile deleterious materials are localized, that is, retained and accumulated in the filter body and prevented from spreading and forming heavy deposits throughout the incinerator furnace.

DESCRIPTION OF THE PREFERRED EMBODIMENTS

To prevent distribution and deposition throughout the incinerator furnace of the non-gaseous constituents containing deleterious material produced in the combustion of organic substances, and to localize such non-gaseous material, primarily in the form of dust and ash accumulations at a definite restricted zone in an incinerator furnace for organic substances, there is provided in accordance with the invention, a filter body which is cup-shaped and arranged within an incinerating chamber of the incinerator furnace with the opening of the filter body at a feed opening of the incinerating chamber for introducing oxygen-containing gas. The filter body portion extending from the feed opening for the oxygen-containing gas, forms a receiving space for the organic substances to be incinerated. Harmful and dangerous materials from the organic substances such as radioactive actinides which cannot be converted into gaseous substances by combustion in the incinerator chamber and are usually in oxide form are retained on and in the restricted zone of the cup-shaped filter body which covers the feed opening for the oxygen-containing gas in the incinerator chamber. The gaseous combustion products pass through the filter body and further combustion of the incompletely burned gaseous constituents may occur during the passage through the filter body. The dangerous and harmful substances which were present in the organic substances to be incinerated only in small concentration, are collected in the filter body in the form of oxides, and can be removed from the incinerator furnace together with the filter body and subsequently further processed.

Post-combustion of the incompletely burned exhaust gases which pass through the filter body may be effected in the incinerator chamber space surrounding the filter body. To insure adequate oxygen for the post-combustion, it may be advantageous to provide the incinerator chamber with a further input stub for oxygen-containing gas remote from the discharge opening for exhaust gas, preferably at the top of the incinerator chamber about 180° from the discharge opening for exhaust gas. Additionally, a reaction tube to facilitate post-combustion is located within the incinerator chamber and has one end connected to the discharge opening for the exhaust gas and the other end of the exhaust tube is open for the entrance of exhaust gas.

It is further advantageous if a device is provided for generating a pressure gradient which is aimed from the side of the filter body facing the feed opening for oxygen-containing gas to the side facing the exit opening for exhaust gas. This permits continuous charging of the incinerator furnace with organic substances to be incinerated.

The invention and its advantages will be explained in greater detail by an embodiment example, making reference to the drawing.

An incinerator furnace shown in the drawing comprises a hollow-cylindrical incinerating chamber 2. This incinerating chamber 2 is closed at the lower end, and it is provided with an inward flange 21 at the open upper end. A hollow-cylindrical filter body 1 open at one end rests with an outward flange 22 on the outside of the top side of the inward flange 21 of the incinerating chamber 2, while the other end of the filter body 1 which is located within the incinerating chamber 2, is closed. A cover 11 is disposed on the top side of the outward flange 22 of the filter body 1. Cover 11 has a central opening 12 and is provided with centering pins 10 engaging the outward flange 22 of the filter body 1. An open stub 13 is located on the outside of the central opening 12 and is the feed opening of the incinerating chamber 2 for oxygen-containing gas as well as a charging opening for an organic substance to be incinerated. The feed opening of the incinerating chamber 2 for oxygen-containing gas and its charging opening for the organic substance to be incinerated are therefore covered by the filter body 1.

Electric heating elements 5 are around the outside cylinder surface of the incinerator chamber 2. The incinerating chamber 2 and the electric heating elements 5 are inserted into a thermal insulation container 6 which is covered by a heat insulating cover 7. The heat insulation cover 7 has a central feedthrough 14 which is engaged by the stub 13 of the cover 11. On the top side of the heat insulating cover 7, a charging hopper 8 for the organic substance to be incinerated has a funnel neck which opens into the stub 13.

A further entrance stub 15 for oxygen-containing gas which opens into the incinerating chamber 2 between the filter body 1 and the jacket of the incinerating chamber 2 is brought through the inward flange 21 of the incinerating chamber 2 and the heat insulating cover 7. A discharge stub 9 for exhaust gas which makes a transition within the incinerating chamber 2 into a reaction tube 4 which extends to the bottom of this incinerating chamber 2 and is located between the filter body 1 and the jacket of the incinerating chamber 2 is brought through the inward flange 21 of the incinerating chamber 2 and the heat insulating cover 7. The discharge stub 9 is equipped with a suction fan 16 for the exhaust gas.

Advantageously, the filter body 1 consists of porous ceramic such as $A1_2O_3$ or porous sintered metal, for instance, chrome nickel steel.

Comminuted organic waste substances which accumulate in the manufacture of plutonium-containing nuclear fuel, for instance, cellulose, are filled through the hopper 8 into a receiving space 3 formed by the filter body 1. The incinerating chamber 2 is heated by the electric heating elements 5 and the suction fan 16 is put in operation. Oxygen is introduced through the entrance stub 15 into the incinerating chamber 2. Combustion air is drawn in through the charging hopper 8 and the stub 13 into the receiving space 3 for the organic waste substances, in which space these waste substances are incinerated. The gaseous combustion products pass through the pores of the filter body 1 and are subjected to post-combustion in the space between the filter body 1 and the wall of the incinerating chamber 2, such that the exhaust gas containing water and carbon dioxide is discharged from the discharge stub 9 into the environment.

$PuO_2$ accumulates in powder form on the inside of the filter body 1 on which the feed opening, formed by the stub 13, of the incinerating chamber 2 for oxygen-containing gas and the receiving space for the organic substances to be incinerated are located. After disassembly of the filter body 1, the $PuO_2$ can be removed therefrom and processed further.

The foregoing is a description corresponding, in substance, to German application No. P 34 38 681.5, dated Oct. 22, 1984, international priority of which is being claimed for the instant application and which is hereby made part of this application. Any material discrepancies between the foregoing specification and the specification of the aforementioned corresponding German application are to be resolved in favor of the latter.

There is claimed:

1. Incinerator furnace for incinerating organic substances, especially compounds which contain radioactive actinides in chemically bound form, or substances which are contaminated with chemical compounds of the radioactive actinides comprising, an incinerating chamber, a feed opening in the chamber for the introduction of oxygen-containing gas as well as for an organic substance to be incinerated, a discharge opening in the chamber for the discharge of exhaust gas, the combination therewith of a gas-permeable, pot-shaped filter body with an inlet opening arranged in the chamber with the inlet opening of the pot-shaped filter body covering said feed opening for the introduction of the oxygen-containing gas and the organic substance into a receiving space in the filter body for the organic substances to be incinerated, and with the filter body closed at its bottom opposite the inlet opening, said filter body upon oxidation of the organic substances thereinto gaseous constituents and higher boiling substantially nonvolatile constituents effects separation of the gaseous constituents by permeation through the walls of the filter body while collecting and retaining the nonvolatile constituents in the receiving space of the filter body; wherein the filter body extends down from an approximately centrally located feed opening in the chamber, wherein the discharge opening is located at the top of the chamber and has a reaction tube connected thereto which extends to a point near the bottom of the chamber, at which point the exhaust gas enters the reaction tube, and wherein the chamber has a further opening located at the top of the chamber at a point remote from the discharge opening for the introduction of additional oxygen-containing gas into the chamber.

2. Incinerator furnace according to claim 1, wherein the walls of the filter body through which gas permeates consists of porous sintered metal.

3. Incinerator furnace according to claim 1, wherein the walls of the filter body through which gas permeates consists of porous ceramic.

4. Incinerator furnace according to claim 1, includig means for generating a pressure gradient from the side of the filter body facing the feed opening for oxygen-containing gas to the side facing the exit opening for exhaust gas.

* * * * *